United States Patent [19]

Fulmer et al.

[11] 4,106,890

[45] Aug. 15, 1978

[54] AIR DEFLECTOR

[75] Inventors: John Arthur Fulmer, Massillon; David Judson Walker, Medina, both of Ohio

[73] Assignee: The Babcock & Wilcox Company, New York, N.Y.

[21] Appl. No.: 774,822

[22] Filed: Mar. 7, 1977

[51] Int. Cl.[2] ..... F23M 9/02

[52] U.S. Cl. ..... 431/184; 431/183; 239/402.5; 239/406

[58] Field of Search ..... 431/183, 184; 239/402.5, 403-406

[56] References Cited

U.S. PATENT DOCUMENTS

| | | | |
|---|---|---|---|
| 2,242,787 | 5/1941 | Lieberherr | 431/184 |
| 2,260,062 | 10/1941 | Stillman | 431/184 |
| 2,774,590 | 12/1956 | Blanchard | 403/301 |
| 3,664,804 | 5/1972 | Flournoy et al. | 431/183 |

FOREIGN PATENT DOCUMENTS

| | | | |
|---|---|---|---|
| 173,444 | 11/1960 | Sweden | 239/402.5 |

*Primary Examiner*—Carroll B. Dority, Jr.
*Attorney, Agent, or Firm*—J. M. Maguire; E. A. Steen; R. J. Edwards

[57] ABSTRACT

An impeller comprising a pair of axially adjacent plate members. Each of the plate members is formed with a hub and a plurality of laterally spaced segments extending outwardly from the hub. The plate members are coaxially mounted on a burner nozzle guide tube, with the plate member nearest the nozzle outlet being fixed to the guide tube and the other plate member being rotatable about its central axis to regulate the free flow area between segments.

1 Claim, 6 Drawing Figures

AIR DEFLECTOR

BACKGROUND OF THE INVENTION

The present invention relates to fluent fuel burners, and more particularly to an improved impeller which provides the turbulence required for efficient combustion by compensating for changes in volume of the combustion air over the burner load range, or for differences in volume between the combustion air and other sources of oxygen.

Burners firing fluent fuels require considerable turbulence to achieve optimum combustion. Turbulence is generally the function of overall burner design and air-side pressure drop across the burner. The higher the pressure drop, the greater the turbulence. When a burner is designed for optimum combustion at full load, its pressure drop at ½ load is only ¼ of the full load pressure drop, since air-side pressure drop is proportional to the square of the ratio of air flows.

The present state of the art provides an impeller of the type disclosed in U.S. Pat. No. 2,260,062 assigned to the assignee of the present invention and generally comprising a frusto-conical plate having a central opening for admitting a liquid fuel burner sprayer plate and including a series of blades formed by bending out portions of the plate leaving openings therethrough for the flow of air or other oxygen-bearing gaseous medium. The impeller is normally located within a frusto-conical section of the burner port and is movable along the burner axis to change the free flow area between the impeller and burner port thereby compensating for changes in volume of the combustion air or other oxygen-bearing gaseous medium flowing therethrough.

It has been found, however, that on wide range burners, a design providing optimum air-side pressure drop at the burner upper load range will experience a reduction in air-side pressure drop at the burner lower load range which is beyond the corrective adjustment available through change of impeller position with respect to the burner port.

SUMMARY OF THE INVENTION

The present invention relates to means for further varying the free flow area between the impeller and burner port thereby widening the compensation range for changes in volume of the combustion air or other oxygen-bearing gaseous medium flowing therethrough.

Accordingly, there is provided a fuel burner assembly which includes a frusto-conically shaped impeller comprised of a pair of axially adjacent plate members. Each of the plate members has a perforated central portion and a plurality of laterally spaced segments extending outwardly from the central portion. The plate members are coaxially mounted on a burner nozzle guide tube with the plate member nearest the nozzle outlet being fixed to the guide tube and the other plate member being rotatable about its central axis to regulate the free flow area between segments. Each of the segments has at least one opening extending therethrough and a tab disposed adjacent the opening, with the tabs projecting away from the adjoining surfaces of the plate members.

DESCRIPTION OF THE PREFERRED EMBODIMENT

Figure 1:
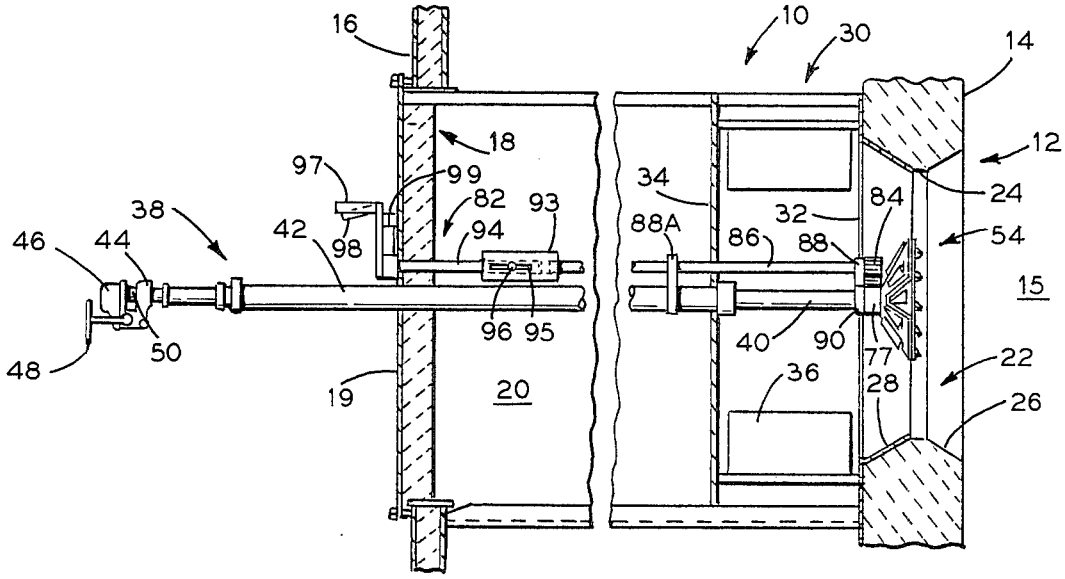
FIG. 1 is a sectional elevation including the fuel burner assembly embodying the invention.
Figure 2:
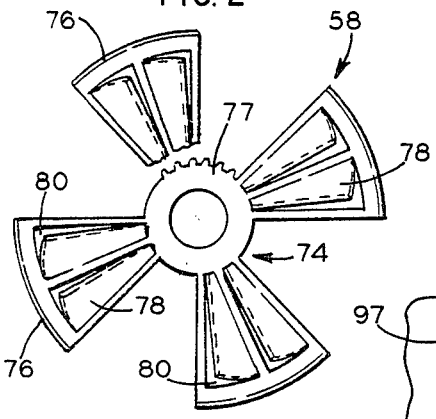
FIG. 2 is a detail view of the rotatable member of the impeller.
Figure 3:
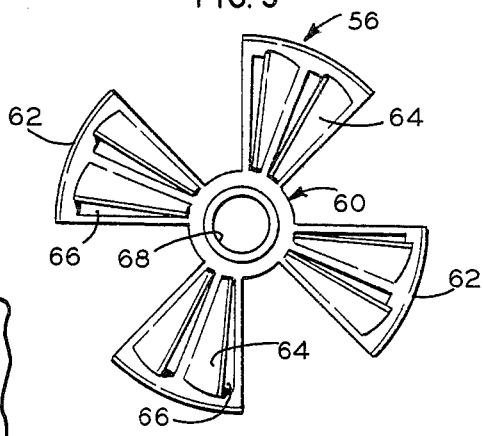
FIG. 3 is a detail view of the fixed member of the impeller.
Figure 6:
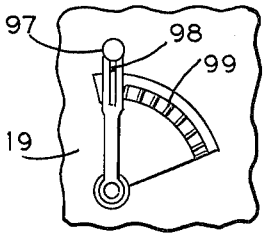
FIG. 6 is a detail of the crank for operating the rotatable member of the impeller.

Referring to FIG. 1, there is shown a fuel burner assembly 10 arranged to fire through a circular port 12 formed in a refractory lined front wall 14 of a furnace chamber 15. A burner wall 16 is spaced from the furnace front wall 14 and includes an access port 18. A cover plate 19 is bolted to the burner wall 16 and forms a gastight closure over the access port 18. The space between the burner and front walls forms a windbox or passageway 20 to which combustion air is supplied from a suitably controlled source, not shown. The circular port 12 is lined with a throat 22 which is formed of a narrow cylindrical section 24 connected at its discharge edge with a refractory lined flaring section 26 and at its inlet edge with the smaller diameter end of a metal-lined frusto-conical section 28.

The fuel burner assembly 10 includes a cylindrical register 30 located within the windbox 20 and suitably supported therefrom and arranged to receive combustion air for discharge through the burner throat 22. The register 30 includes a front annular plate 32 and a back circular plate 34 spaced from one another to accommodate a plurality of circumferentially arranged vanes 36 pivotally mounted therebetween so as to be rotatable about their respective axes, each of which is substantially parallel with the central axis of the port 12. Although no register operating devices are shown in the drawings, it should be recognized that there are known devices operable from without the windbox 20 for simultaneously pivoting the vanes 36 about their respective axes.

Figure 5:
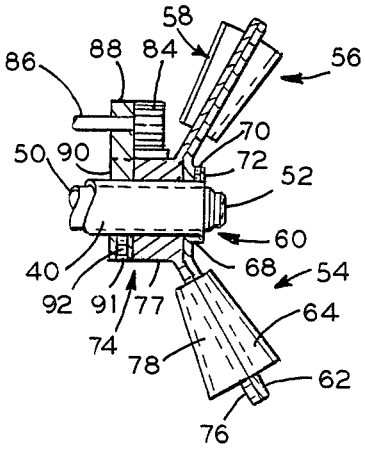
FIG. 5 is a detail sectional side view of the impeller.
Figure 4:
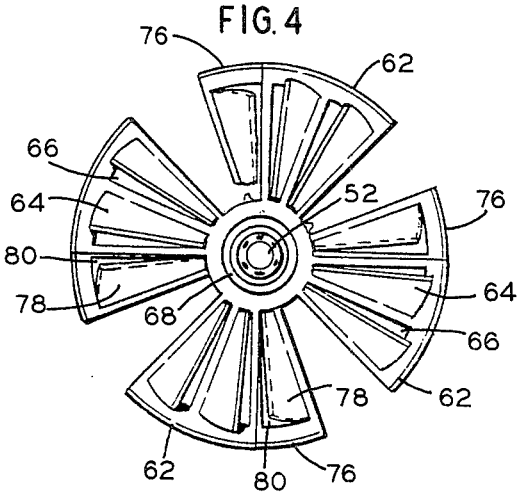
FIG. 4 is a detail view of the impeller adjusted to partially cut-off the free flow area between segments.

The fuel burner assembly 10 includes a liquid fuel burner 38 comprising a guide tube or distance piece 40 extending along the central axis of the fuel burner assembly 10, and supported by an elongated sleeve 42. The sleeve 42 extends through the cover plate 19 and the back register plate 34 and is fixedly supported therefrom. The distance piece 40 has one end threadably engaged with a yoke 44, the latter being connected to the liquid fuel and atomizing fluid lines, not shown. The discharge end of the yoke 44 is connected to an atomizer 46 for the through passage of fuel and atomizing fluid. A leak-proof fit between the yoke 44 and the atomizer 46 is achieved by introducing a gasket, not shown, between the mating surfaces and applying pressure with a locking device 48. A barrel tube 50 is connected at its inlet end to the atomizer 46 and at its outlet end to a sprayer plate 52, shown at FIG. 5. The barrel tube 50 extends through the distance piece 40 and out the distal end thereof, and combines with the sprayer plate 52 to form the discharge nozzle of the liquid fuel burner 38.

In accordance with the preferred embodiment and referring to FIGS. 1 through 6, there is shown a combustion air deflector or impeller 54 coaxially mounted onto the distal end of the distance piece 40. The impeller 54 is comprised of a pair of axially adjacent plate members 56 and 58. The plate member 56 is situated nearest to the sprayer plate 52 and is fixedly connected to the distance piece 40, whereas the plate member 58 is rotatable about its central axis. The fixed plate member 56 is provided with a central portion or hub 60 and four laterally spaced flared segments 62 projecting outwardly therefrom. Each of the segments 62 is formed with a pair of tabs 64 bent out in the direction of the furnace chamber 15 and leaving corresponding openings 66 through which air may flow. The hub 60 includes a sleeve section 68 and is internally threaded to engage a threaded distal end portion of distance piece 40. The wall of sleeve section 68 includes two or more circumferentially spaced tapped holes, one of which is shown at 70, which engage corresponding set screws 72 to secure the hub 60 to the distance piece 40. The rotatable plate member 58 is provided with a central portion or hub 74 and four laterally spaced flared segments 76 projecting outwardly therefrom. Each of the segments 76 is formed with a pair of tabs 78 bent out in the direction of the windbox 20 and leaving corresponding openings 80 through which air may flow. The hub 74 includes a segmental gear 77 and fits rotatably about the distance piece 40.

The flared segments 62 and 76 are of substantially uniform dimension and, preferably, lie along laterally arcuate planes which are longitudinally divergent in the direction of the furnace chamber 15. It should be recognized that the number and shape of the segments and the openings extending therethrough may differ from that shown and described with respect to the preferred embodiment.

A device 82 is provided for positioning the rotatable plate member 58 and includes a pinion 84 engaged with the segmental gear 77 and fixedly mounted at one end of a shaft 86. A bearing member 88 supports the pinion-end of shaft 86 and includes a collar section 90 mounted on the distance piece 40. The wall of the collar section 90 includes three or more circumferentially spaced tapped holes, one of which is shown at 91, which engage corresponding set screws 92 to secure the collar section 90 to the distance piece 40 and maintain radial alignment between the pinion 84 and the segmental gear 77. The shaft 86 may be further supported by one or more bearing members 88A which may be of substantially the same character as the member 88 and are secured to the support sleeve 42. The other end of shaft 86 is fixedly connected to a sleeve 93 which is in turn slidably mounted onto one end of a shaft 94 and is slotted at 95 to receive the ends of a pin 96 extending diametrically through the shaft 94 and sized to engage the sides of slot 95 while permitting longitudinal movement of the sleeve 93 over the shaft 94. The shaft 94 carries a crank 97 which is adapted to be moved in an arc across the front of the cover plate 19 to adjust the position of the rotatable plate member 58 relative to the fixed plate member 56. The crank 97 may be set at any desired position by means of a trigger 98 engaging a toothed quadrant 99 mounted on the cover plate 19. In the arrangement shown at FIGS. 1 and 6, the crank 97 is at its extreme left position and the segments 62 and 76 are axially offset so as to close-off the free flow area between segments. When the crank 97 is at its extreme right position, the segments 62 and 76 are axially aligned so as to provide maximum free flow area between segments. Moreover, the crank shaft structure, which includes the arrangement of sleeve 93 being slidable over the shaft 94, preserves the traditional burner free flow area adjustment provided for by moving the impeller 54 longitudinally along the burner central axis.

In the operation of the preferred embodiment, the vanes 36 impart a whirling effect to the combustion air passing through the register 30. The central portion of the whirling air stream contacts the impeller 54 with some of the air passing through the openings 66 and 80 and the remainder passing through the spaces between the segments 62 and 76. This central portion of the air stream mixes with the liquid fuel conical spray issuing from the sprayer plate 52 and the expanding mixture of air and fuel is subsequently mixed with the portion of the air stream passing through the annular passage formed between the outer periphery of the impeller 54 and the wall of the burner throat 22. In accordance with the present invention, whenever there is a reduction in the volume of combustion air passing through the burner throat 22 with a concomitant reduction in burner pressure drop below the optimum range, and assuming that the impeller 54 is set within the narrow throat section 24, the crank 97 should be repositioned toward the left so as to reduce the free flow area between the impeller segments 62 and 76. Conversely, an increase in the volume of combustion air with a concomitant increase in burner pressure drop above the optimum range will require that the impeller be set within a wider portion of the throat 22 and the crank 97 be repositioned toward the right so as to increase the free flow area between the impeller segments 62 and 76.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In combination with a furnace wall having a circular port extending therethrough, the port being formed with inlet and outlet frusto-conical sections and a constricted section disposed therebetween, the inlet and outlet sections converging in the direction of the constricted section, a burner wall spaced from the furnace wall to form a windbox therebetween to which pressurized air is supplied, a fluid fuel burner including an air register of circular cross section disposed within the windbox and having a discharge end adjacent and opening to the inlet section of the port, the register being arranged to discharge a whirling stream of high velocity air through the port, a circular impeller disposed axially within and in radially spaced relation to the port, the impeller comprising a pair of axially adjacent plate members, each plate member having a hub, a plurality of laterally spaced segments extending outwardly from the hub, the segments being formed with openings defining a fixed free flow area therethrough, means including a shaft for rotating at least one of the plate members about its central axis to provide a first adjustable free flow area between said segments, means including a guide tube extending through each hub for moving the impeller longitudinally through the port to provide a second adjustable free flow area therebetween, means connecting each hub with the guide tube while accommodating rotation of at least one of the members with respect to the guide tube, the shaft including a pair of coaxial sections, a sleeve interconnecting the sections, one of the sections being fixedly connected to the sleeve, the other section being fitted with a guide pin, the sleeve being slotted to engage the pin and permit longitudinal movement between the pinned and fixed sections thereby allowing for adjustment of the second free flow area independently of the first free flow area.

* * * * *